US009178321B2

(12) United States Patent
Chiang et al.

(10) Patent No.: US 9,178,321 B2
(45) Date of Patent: Nov. 3, 2015

(54) MODULAR TUNER AND METHOD FOR MANUFACTURING THE SAME

(71) Applicant: WISTRON CORP., New Taipei (TW)

(72) Inventors: Sheng-Yuan Chiang, New Taipei (TW); Yung-Han Wang, New Taipei (TW); Tien-Cheng Feng, New Taipei (TW)

(73) Assignee: WISTRON CORP., New Taipei (TW)

( * ) Notice: Subject to any disclaimer, the term of this patent is extended or adjusted under 35 U.S.C. 154(b) by 0 days.

(21) Appl. No.: 14/074,726

(22) Filed: Nov. 8, 2013

(65) Prior Publication Data

US 2015/0050832 A1 Feb. 19, 2015

(30) Foreign Application Priority Data

Aug. 19, 2013 (TW) ..... 102129681 A

(51) Int. Cl.

| | |
|---|---|
| ***H01R 9/03*** | (2006.01) |
| ***H01R 13/6594*** | (2011.01) |
| ***H01R 13/6581*** | (2011.01) |
| *H01R 12/71* | (2011.01) |

(52) U.S. Cl.
CPC ..... *H01R 13/6594* (2013.01); *H01R 13/6581* (2013.01); *H01R 12/712* (2013.01)

(58) Field of Classification Search
CPC ..... H01R 13/658; H01R 13/65802
USPC ..... 439/607.55, 95
See application file for complete search history.

(56) References Cited

U.S. PATENT DOCUMENTS

| | | | | |
|---|---|---|---|---|
| 4,698,459 | A * | 10/1987 | Drake | 174/138 F |
| 6,870,092 | B2 | 3/2005 | Lambert et al. | |
| 2012/0315790 | A1* | 12/2012 | Hein et al. | 439/574 |
| 2013/0231005 | A1* | 9/2013 | Qiao et al. | 439/607.55 |

FOREIGN PATENT DOCUMENTS

| | | | |
|---|---|---|---|
| EP | 1793457 | A2 | 6/2007 |
| EP | 0874419 | B1 | 5/2008 |
| TW | M350872 | U | 2/2009 |

OTHER PUBLICATIONS

The office action of the corresponding Taiwan application issued on Jun. 11, 2015 and its partial English translation.

* cited by examiner

*Primary Examiner* — Abdullah Riyami
*Assistant Examiner* — Thang Nguyen
(74) *Attorney, Agent, or Firm* — CKC & Partners Co., Ltd.

(57) ABSTRACT

Disclosed herein are a modular tuner and a method for manufacturing the same. The modular tuner includes a metallic casing, a tuner adaptor and a plurality of metallic elastic pieces. The metallic casing has an opening, and the tuner adaptor has a metallic outer surface. The plurality of metallic elastic pieces and the metallic casing are integrally formed by stamping followed by bending, and the metallic elastic pieces extend outwardly from the edge of the opening of the metallic casing and respectively interfere with the metallic outer surface of the tuner adaptor.

5 Claims, 12 Drawing Sheets

MODULAR TUNER AND METHOD FOR MANUFACTURING THE SAME

RELATED APPLICATIONS

This application claims priority to Taiwanese Patent Application No. TW102129681, filed Aug. 19, 2013, the entirety of which is herein incorporated by reference.

BACKGROUND

1. Technical Field

The present disclosure relates to a tuner; more particularly, a modular tuner and a method for manufacturing the same.

2. Description of Related Art

Tuners include the FM/AM tuner comprised in certain main stations and television tuners. A television tuner (also known as high frequency tuner) is an important component in the receiving terminal end of a television. Common television tuners complete the process of receiving, amplifying, strobing, frequency conversion and demodulation in an analog way; if any distortion or loss of fidelity occurs during said process, the quality of the received image and accompanying sound would be degraded.

Referring to FIG. 1; while assembling the tuner, the adaptor 120 is inserted into the iron casing 110 and then the riveting part 122 is planished to clasp the iron casing 110. However, due to the fault tolerance of the mold used in the planishing, the process cannot effectively force the iron casing 110 to interfere with the riveting part 122; accordingly, there are gaps between the adaptor 120 and the iron casing 110, and between the iron casing 110 and the riveting part 122, as illustrated in FIG. 2. When the tuner is under a high frequency, a potential difference exists between the two parallel polar plates, and hence the parasitic capacitance is generated in the gaps, which will cause problems associated with excessive contact resistance, and accordingly, the tuner may not be in compliance with the electromagnetic compatibility (EMC) regulations.

On the other hand, the iron casing 110 and adaptor 120 of the tuner are connected via riveting connection, which renders the unpacking of the tuner quite difficult. Also, in the case where the adaptor type of the tuner shall be altered, it is requisite to build a new mold, thereby increasing the manufacturing cost.

The above-mentioned parasitic capacitance is calculated according to the following equation:

$$Xc=1/(2\pi f\in A),C=(\in A)/d,$$

where Xc is the capacitive reactance (Ohmic, Ω), C is the parasitic capacitance (Farad, F), f is the frequency (Hertz, Hz), ∈=dielectric constant of air (Farad/meter, F/m), A is the cross-over area of the adaptor and the casing (meter-square, $m^2$), and d is the distance between the adaptor and the casing (meter, m).

The presence of the parasitic capacitance will result in the potential difference $V_{AB}$, and the potential difference is calculated according to the following equation:

$$V_{AB}=W_{AB}/Q=(W_A-W_B)/Q,$$

where $V_{AB}$ is the potential difference (Volt, V), $W_{AB}$ is the energy (Joule, J and Q is the electric quantity (Coulomb, C).

The potential difference further results in an electric field which in turn cause the generation of an electromagnetic wave, and the electric field intensity is calculated according to the following equation:

$$E=V/d,$$

where E is the electric field intensity (Volt/meter, V/m), V=is the potential difference (Volt, V), and d is the distance (meter, m).

To eliminate said electromagnetic wave, it is required to eliminate the potential difference between the adaptor 120 and the iron casing 110 of the tuner. In view of the foregoing, there exist problems and disadvantages in the existing products that await further improvement. However, those skilled in the art sought vainly for a solution. In order to solve or circumvent above problems and disadvantages, there is an urgent need in the related field to address the above-mentioned problems and disadvantages so as to improve the EMC.

SUMMARY

The following presents a simplified summary of the disclosure in order to provide a basic understanding to the reader. This summary is not an extensive overview of the disclosure and it does not identify key/critical components of the present invention or delineate the scope of the present invention. Its sole purpose is to present some concepts disclosed herein in a simplified form as a prelude to the more detailed description that is presented later.

In one aspect, the present disclosure provides a modular tuner and a method for manufacturing the same to eliminate the parasitic capacitance.

The modular tuner according to the present disclosure comprises a metallic casing, a tuner adaptor and a plurality of metallic elastic pieces. The metallic casing has an opening, and the tuner adaptor is embedded in the opening and the tuner adaptor has a metallic outer surface. The plurality of metallic elastic pieces and the metallic casing are integrally formed by stamping followed by bending, such that the metallic elastic pieces extend outwardly from the edge of the opening, and respectively interfere with the metallic outer surface of the tuner adaptor.

In one embodiment, the metallic elastic pieces are triangular tooth-like metallic elastic pieces or trapezoidal tooth-like metallic elastic pieces.

In one embodiment, the terminal end of each of the plurality of triangular tooth-like metallic elastic pieces has a bending section, and the bending section directly contacts the metallic outer surface of the tuner adaptor.

In one embodiment, the metallic casing comprises a metallic casing body and a metallic casing lid. The metallic casing body has at least three side walls, wherein one of the three side walls has the opening disposed thereon, and the plurality of triangular tooth-like metallic elastic pieces or the plurality of trapezoidal tooth-like metallic elastic pieces are arranged along a portion of the edge of the opening; the metallic casing lid is coupled to the other two side walls of the metallic casing body.

In one embodiment, the tuner adaptor has an annular groove, the opening has a notch formed on the upper edges of the side walls, and the metallic casing lid has a fastening, wherein the fastening is introduced into the notch and inserted into the annular groove thereby fixing the tuner adaptor.

In one embodiment, the metallic casing lid has a plurality of extension sections, and each extension section has a knock hole; the two side walls of the metallic casing body have a plurality of latching members, and the plurality of latching members are respectively coupled to the knock holes of the plurality of extension sections.

In one embodiment, the lower edges of the at least three side walls of the metallic casing body have a plurality of ground pins extended therefrom.

In one embodiment, one terminal end of the tuner adaptor enters the metallic casing body from the opening, and the other terminal end of the tuner adaptor has a surface mount pin or an inline pin.

On the other hand, the method for manufacturing a modular tuner according to the present disclosure comprises the following steps: performing a stamping process such that a plurality of metallic elastic pieces of a metallic casing are bent and formed from the opening of the metallic casing toward the exterior of the metallic casing; and embedding a tuner adaptor in the opening, such that the plurality of metallic elastic pieces respectively interfere with the metallic outer surface of the tuner adaptor.

In one embodiment, the manufacturing method further comprises: before performing the stamping process, performing a cutting process, such that a plurality of metallic elastic pieces and a metallic part interlocking with the plurality of metallic elastic pieces are cut at the opening of the metallic casing; and while performing the stamping process, removing the metallic part interlocking with the plurality of metallic elastic pieces, and bending and forming the plurality of metallic elastic pieces.

In one embodiment, metallic elastic pieces are triangular tooth-like metallic elastic pieces or trapezoidal tooth-like metallic elastic pieces.

In one embodiment, stamping process comprises: applying a first stamping on the terminal ends of the plurality of triangular tooth-like metallic elastic pieces, such that the terminal end of each of the plurality of triangular tooth-like metallic elastic pieces forms a bending section; and after applying the first stamping, applying a second stamping on the plurality of triangular tooth-like metallic elastic pieces, such that the plurality of triangular tooth-like metallic elastic pieces are bent and formed from the opening.

In one embodiment, metallic casing comprises a metallic casing body and a metallic casing lid, has a notch formed on the upper edges of the side walls, and the manufacturing method comprises when the tuner adaptor is positioned in the opening, combining the metallic casing body and the metallic casing lid, such that a fastening of the metallic casing lid is introduced into the notch and inserted into the annular groove of the tuner adaptor, thereby fixing the tuner adaptor.

In view of the foregoing, the technical solutions of the present disclosure result in significant advantageous and beneficial effects, compared with existing techniques. The implementation of the above-mentioned technical solutions achieves substantial technical improvements and provides utility that is widely applicable in the industry. Specifically, technical advantages generally attained, by embodiments of the present invention, include:

1. The present invention starts from enhancing the EMC and aims at the structural improvements; by using the interference between the tuner adaptor and the metallic elastic pieces to lower the parasitic capacitance between the adaptor and the metallic casing and decrease the impedance, thereby improving the shielding effect of the tuner; and 2. Regarding the metallic casing and the tuner adaptor, a flexible means for connecting and assembling the two is adopted which decreases the manufacturing cost associated with creating new molds as well as research and development cost.

Many of the attendant features will be more readily appreciated, as the same becomes better understood by reference to the following detailed description considered in connection with the accompanying drawings.

BRIEF DESCRIPTION OF THE DRAWINGS

The present description will be better understood from the following detailed description read in light of the accompanying drawing, wherein.

DETAILED DESCRIPTION

Figure 1:
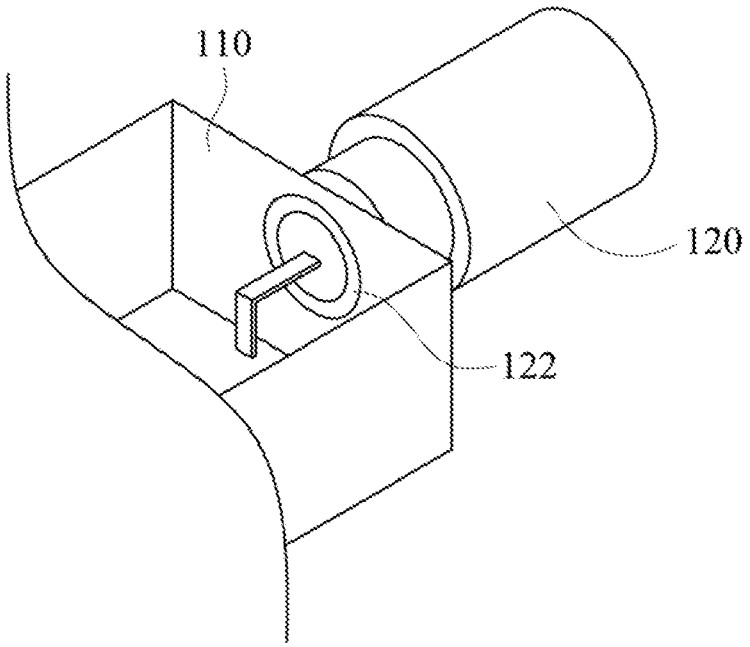
Fig. 1 ( PRIOR ART )
FIG. 1 is a diagram illustrating a partial structure of a conventional tuner.
Figure 2:
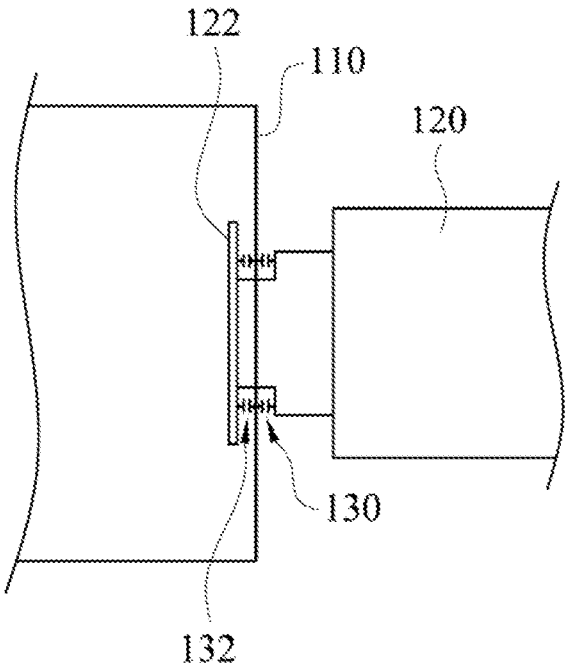
Fig. 2 ( PRIOR ART )
FIG. 2 is a diagram illustrating a partial structure of the tuner of FIG. 1 from another viewing angle.

In the following detailed description, for purposes of explanation, numerous specific details are set forth in order to attain a thorough understanding of the disclosed embodiments. In accordance with common practice, the various described features/elements are not drawn to scale but instead are drawn to best illustrate specific features/elements relevant to the present invention. Also, like reference numerals and designations in the various drawings are used to indicate like elements/parts. Moreover, well-known structures and devices are schematically shown in order to simplify the drawing and to avoid unnecessary limitation to the claimed invention.

Figure 3:
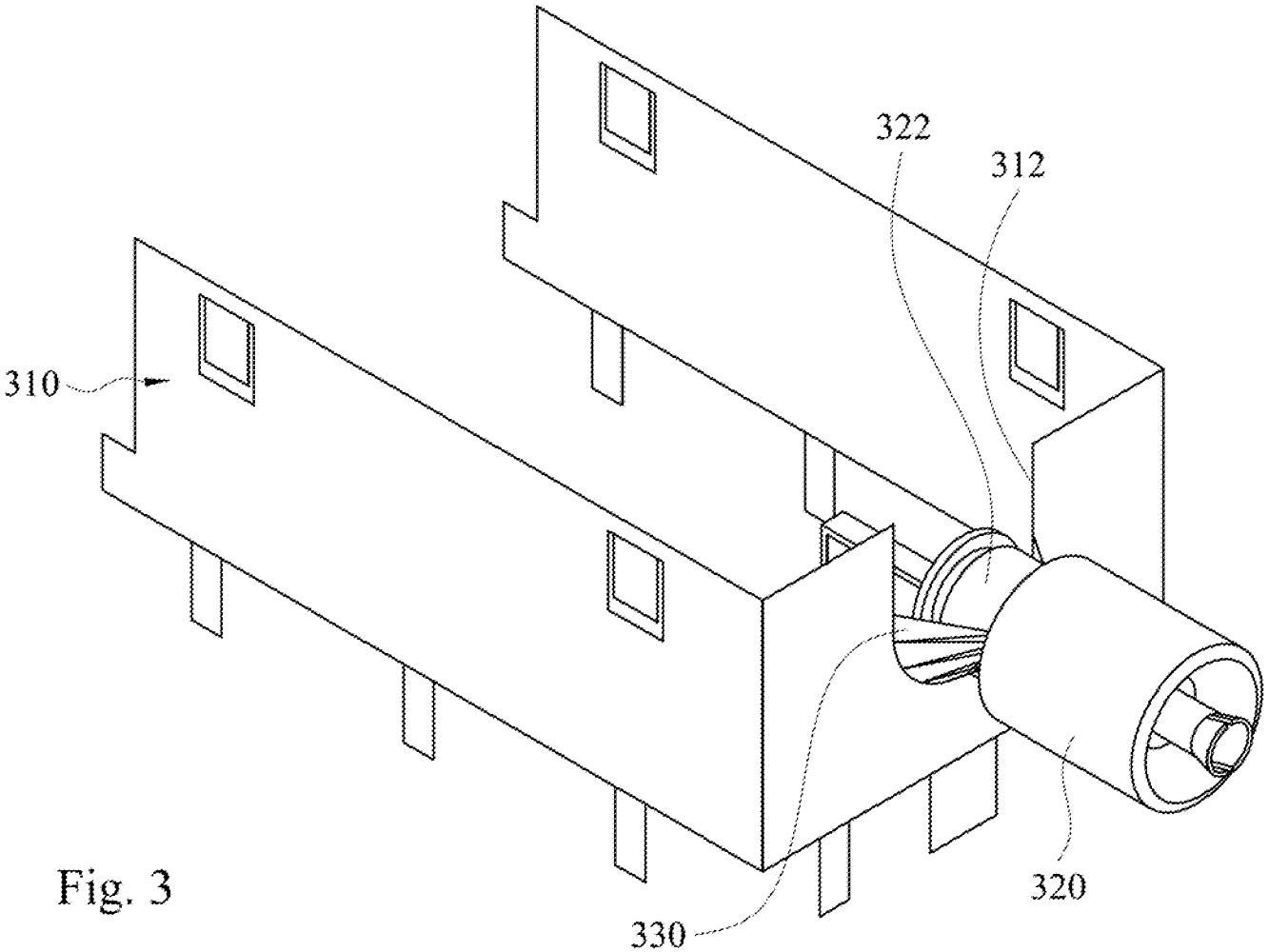
FIG. 3 is a diagram illustrating a partial structure of a modular tuner according to one embodiment of present disclosure.

FIG. 3 is a diagram illustrating a partial structure of a modular tuner according to one embodiment of present disclosure. As illustrated in FIG. 3, the modular tuner comprises a metallic casing 310, a tuner adaptor 320 and a plurality of metallic elastic pieces 330. The metallic casing 310 has an opening 312, the tuner adaptor 320 has a metallic outer surface 322. The plurality of metallic elastic pieces 330 and the metallic casing 310 are integrally formed by stamping followed by bending, such that the metallic elastic pieces 330 extend from the edge of the opening 312 toward the exterior of the metallic casing 310. Regarding the assembly, the tuner adaptor 320 is embedded in the opening 312, and the plurality of metallic elastic pieces 330 respectively interfere with the metallic outer surface 322 of the tuner adaptor 320, thereby reducing the parasitic capacitance between the tuner adaptor 320 and the metallic casing 310 and decreasing the impedance, so as to improve the shielding effect of the modular tuner.

Figure 4:
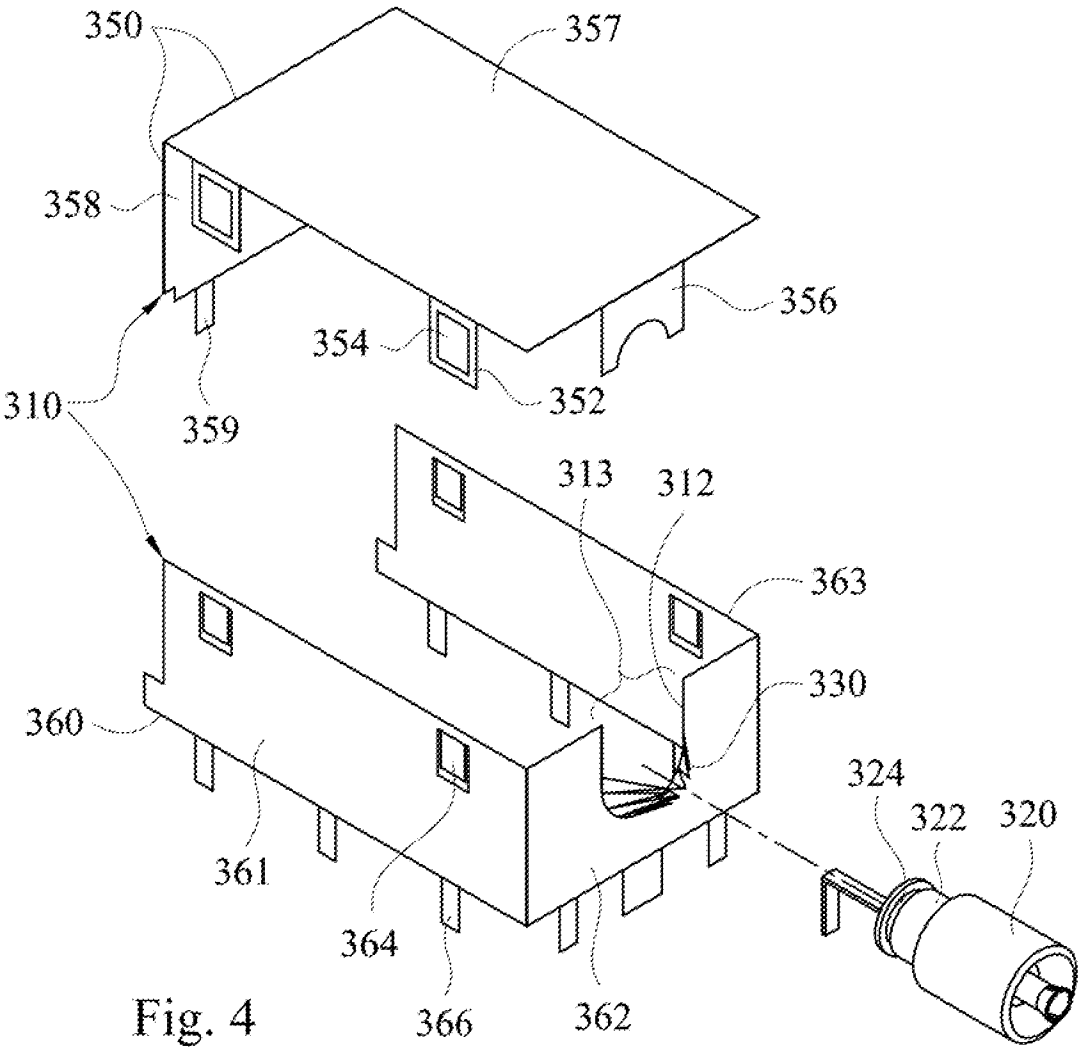
FIG. 4 is an explosion diagram illustrating a modular tuner according to one embodiment of present disclosure.

FIG. 4 is an explosion diagram illustrating a modular tuner according to one embodiment of present disclosure. As illustrated in FIG. 4, the metallic casing 310 comprises a metallic casing body 360 and a metallic casing lid 350. The metallic casing body 360 has at least three side walls 361, 362 and 363; one of the side walls (e.g. side wall 362) has an opening 312 disposed thereon, while the other two side walls (e.g., side walls 361 and 363) are coupled with the metallic casing lid 350 and the metallic casing body 360. In this way, it is feasible to dispose other component in the metallic casing body 360 before covering the metallic casing lid 350, thereby facilitating the assembly process.

In FIG. 4, a plurality of ground pins 366 extend from the lower edges of the at least three side walls 361, 362 and 363 of the metallic casing body 360. In one embodiment, the ground pins 366 may electrically connected to the ground terminal of the print circuit board so as to improve the grounding effect.

Further, the metallic casing lid 350 comprises a top cover portion 357 and a back cover portion 358, and the two portions are formed integrally as one to piece. The top cover portion 357 is configured to engage with the upper edges of the two side walls 361 and 363, whereas the back cover portion 358 is configured to engage with the lateral edges of the two side walls 361 and 363. The lower edge of the back cover portion 358 may also has a plurality of ground pins 359 extending therefrom, and these of ground pins 359 can also be used to improve the grounding effect.

Figure 5:
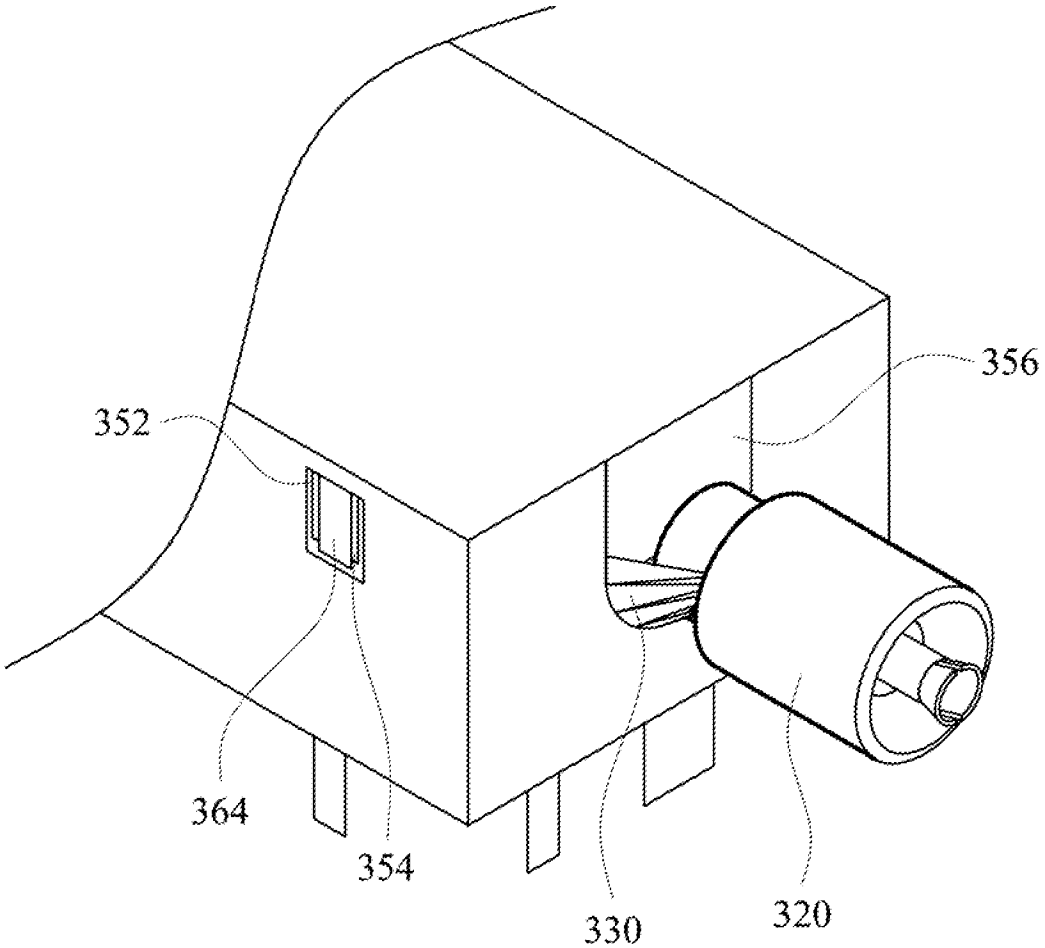
FIG. 5 is a partial structural diagram illustrating the assembly of the metallic casing body and the metallic casing lid of FIG. 4.

The metallic casing lid 350 has a plurality of extension sections 352, and each extension section 352 has a knock hole 354 the two side walls 361 and 363 of the metallic casing body 360 have a plurality of latching members 364; these latching members 364 are respectively connected to the knock holes 354 of the plurality of extension sections 352, as illustrated in FIG. 5, so that the metallic casing lid 350 and the metallic casing body 360 are tightly fastened with each other.

Returning to FIG. 4, the tuner adaptor 320 has an annular groove 324, and the opening 312 has a notch 313 formed on the upper edges of the side walls 362. Regarding the assembly, the metallic casing lid 350 has a fastening 356, and the fastening 356 is introduced into the notch 313 and inserted into the annular groove 324, thereby fixing the tuner adaptor 320, as illustrated in FIG. 5. In this way, the manufacturing cost associated with creating new molds and RD cost can be reduced by flexibly changing the way in which the metallic casing 310 and tuner adaptor 320 are connected and assembled.

Figure 6:
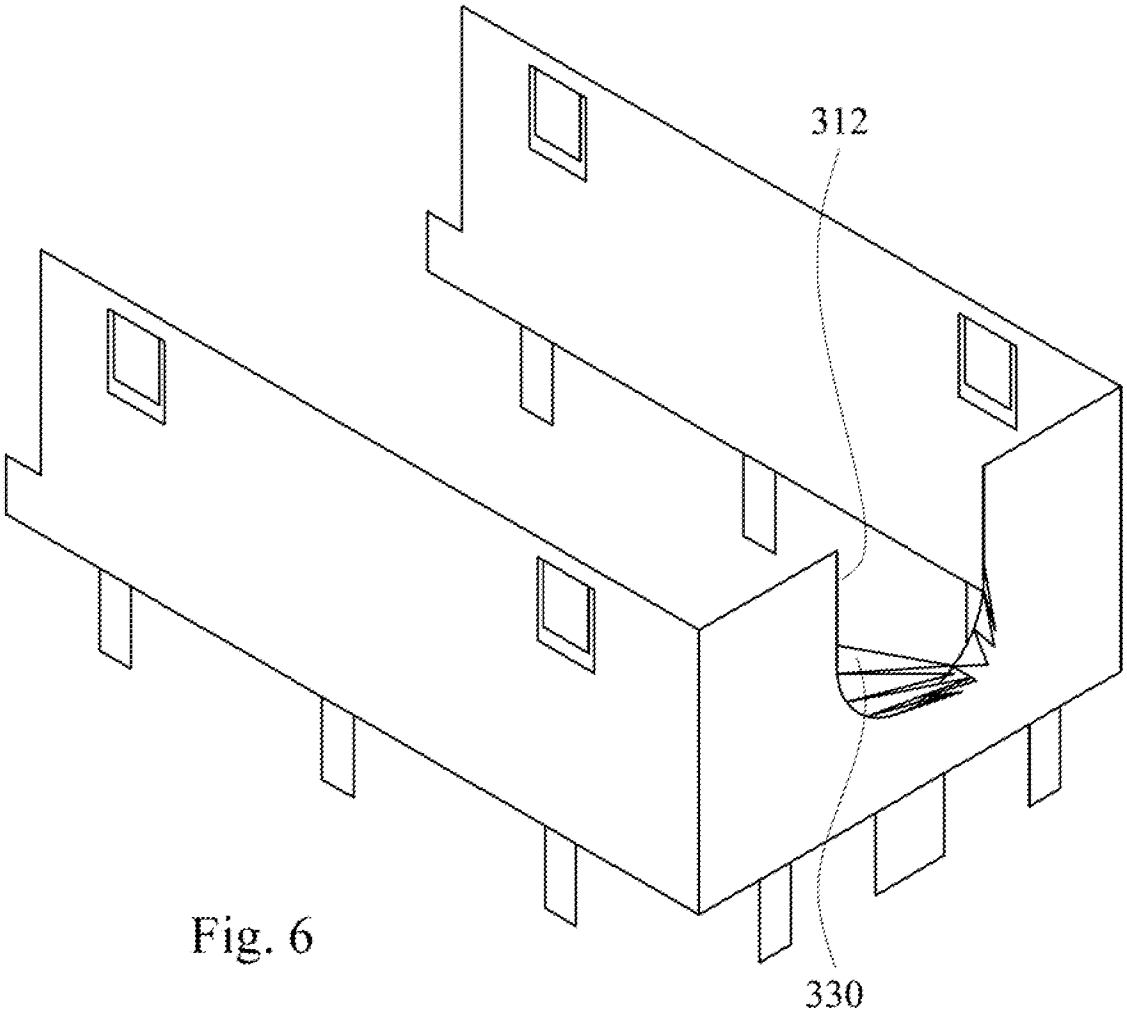
FIG. 6 is a three dimensional diagram illustrating metallic elastic pieces according to one embodiment of present disclosure.

FIG. 6 is a three dimensional diagram illustrating metallic elastic pieces according to one embodiment of present disclosure. As illustrated in FIG. 6, the metallic elastic pieces 330 are triangular tooth-like metallic elastic pieces, wherein the triangular tooth-like metallic elastic pieces are disposed along a portion of the edge of the opening. Regarding the assembly, the three angular tips of the metallic elastic pieces 330 facilitate the interference with the tuner adaptor, and can also be used to support the tuner adaptor.

Figure 7:
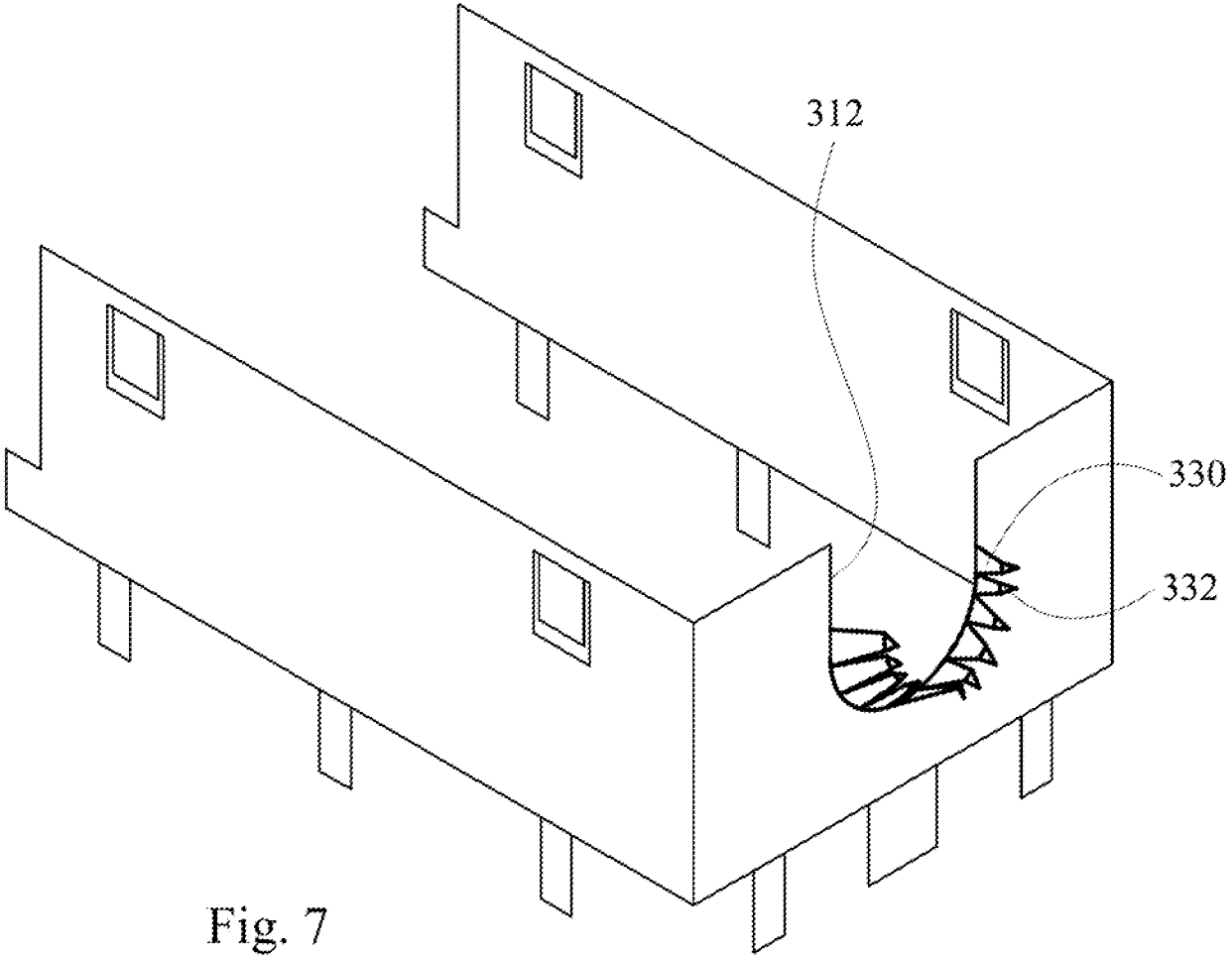
FIG. 7 is a three dimensional diagram illustrating metallic elastic pieces according to another embodiment of present disclosure.

FIG. 7 is a three dimensional diagram illustrating metallic elastic pieces according to another embodiment of present disclosure. As illustrated in FIG. 7, the metallic elastic pieces 330 are triangular tooth-like metallic elastic pieces, the terminal end of each triangular tooth-like metallic elastic piece has a bending section 332, and the bending section 332 is used to directly contact the metallic outer surface of the tuner adaptor, so as to increase the contact area, thereby decreasing the parasitic capacitance and hence lowering the impedance more effectively.

Figure 8:
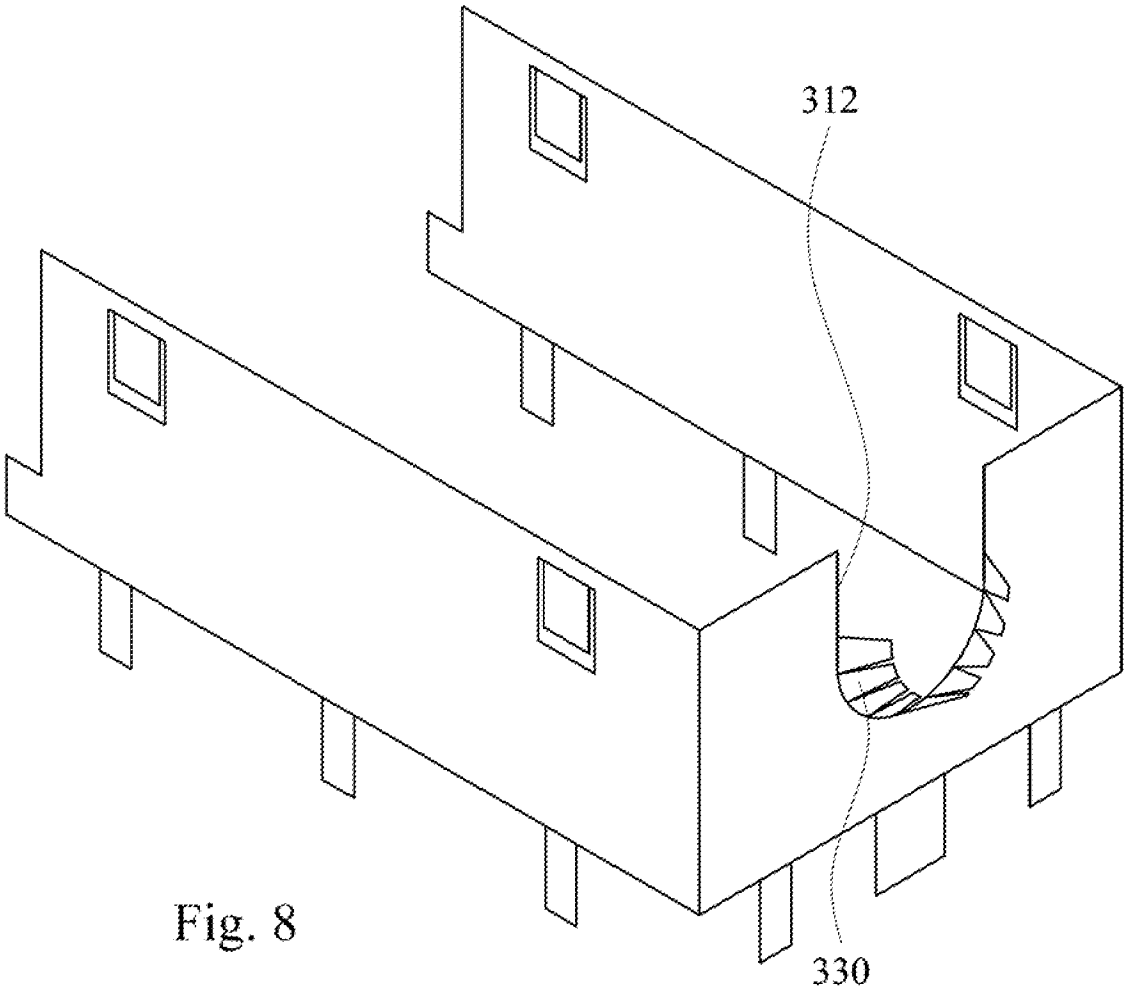
FIG. 8 is a three dimensional diagram illustrating metallic elastic pieces according to yet another embodiment of present disclosure.

FIG. 8 is a three dimensional diagram illustrating metallic elastic pieces according to yet another embodiment of present disclosure. As illustrated in FIG. 8, the metallic elastic pieces 330 are trapezoidal tooth-like metallic elastic pieces, and the trapezoidal tooth-like metallic elastic pieces are disposed along a portion of the edge of the opening 312. Regarding the assembly, the blunt tips of the metallic elastic pieces 330 facilitate the interference with the tuner adaptor, and can also be used to support the tuner adaptor.

Figure 9:
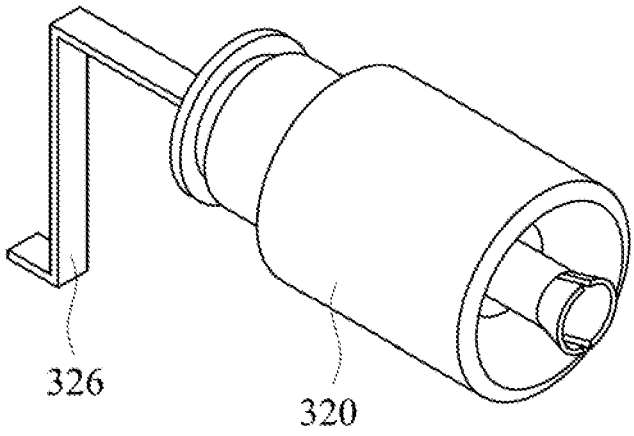
FIG. 9 is a three dimensional diagram illustrating the tuner adaptor according to one embodiment of present disclosure.

FIG. 9 is a three dimensional diagram illustrating the tuner adaptor 320 according to one embodiment of present disclosure. As illustrated in FIG. 9, the tuner adaptor 320 is an adaptor in compliance with the European specification. One terminal end of the tuner adaptor 320 enters the interior of the metallic casing body 360 (illustrated in FIG. 3) from the opening 312, and the other terminal end of the tuner adaptor 320 has a surface mount pin 326 that is suitable for use in the surface mount technology (SMT). SMT is a circuit packaging technology in which the surface mount pin 326 is adhered or soldered onto a pre-determined position on the printed circuit board, and the printed circuit board has no arbitrary through-holes. Specifically, a tin soldering paste is first coated on the printed circuit board; then the surface mount pin 326 is accurately placed on a soldering plate coated with the tin soldering paste; the printed circuit board is then heated until the tin soldering paste melts; and the interconnection between the components and the printed circuit board is accomplished after cooling.

Figure 10:
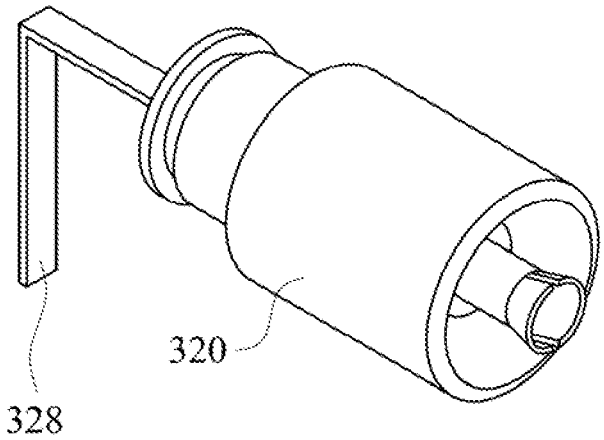
FIG. 10 is a three dimensional diagram illustrating the tuner adaptor according to another embodiment of present disclosure.

FIG. 10 is a three dimensional diagram illustrating the tuner adaptor according to another embodiment of present disclosure. As illustrated in FIG. 10, the tuner adaptor 320 is an adaptor in compliance with the European specification. One terminal end of the tuner adaptor 320 enters the interior of the metallic casing body 360 (illustrated in FIG. 3) from the opening 312, and the other terminal end of the tuner adaptor 320 has an inline pin 328 that is suitable for use in the dual in-line package (DIP) technology in which the inline pin 323 is inserted into a socket having the DIP structure on the printed circuit board.

Figure 11:
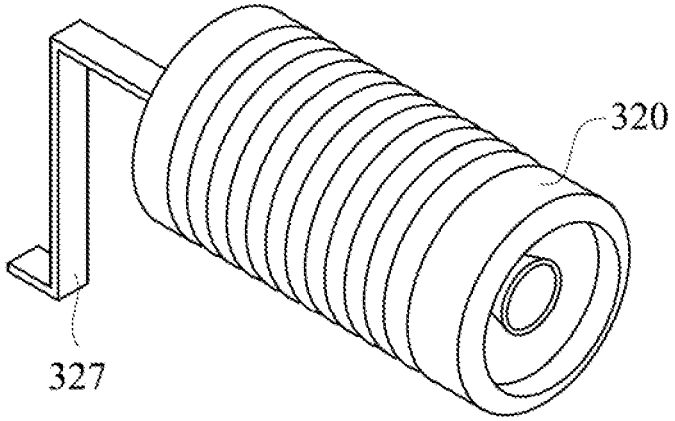
FIG. 11 is a three dimensional diagram illustrating the tuner adaptor according to yet another embodiment of present disclosure.

FIG. 11 is a three dimensional diagram illustrating the tuner adaptor according to yet another embodiment of present disclosure. As illustrated in FIG. 11, the tuner adaptor 320 is an adaptor in compliance with the American specification. One terminal end of the tuner adaptor 320 enters the interior of the metallic casing body 360 (illustrated in FIG. 3) from the opening 312, and the other terminal end of the tuner adaptor 320 has a surface mount pin 327 that is suitable for use in the surface mount technology. The surface mount technology has been specifically disclosed hereinabove, and is hence omitted herein for the sake of brevity.

Figure 12:
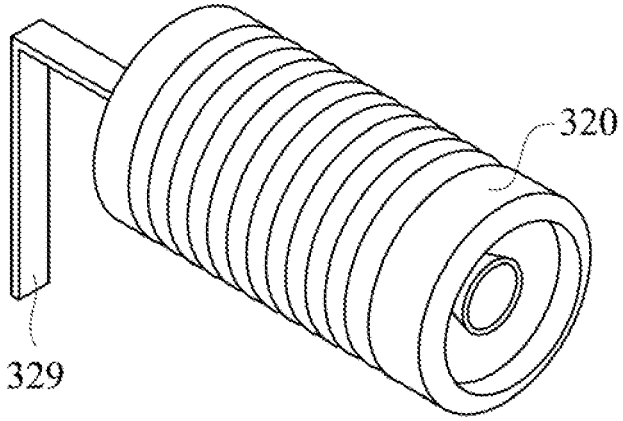
FIG. 12 is a three dimensional diagram illustrating the tuner adaptor according to still another embodiment of present disclosure.

FIG. 12 is a three dimensional diagram illustrating the tuner adaptor according to still another embodiment of present disclosure. As illustrated in FIG. 12, the tuner adaptor 320 is an adaptor in compliance with the American specification. One terminal end of the tuner adaptor 320 enters the interior of the metallic casing body 360 (illustrated in FIG. 3) from the opening 312, and the other terminal end of the tuner adaptor 320 has a inline pin 329 that is suitable for use in the dual in-line package technology. The dual in-line package technology has been specifically disclosed hereinabove, and is hence omitted herein for the sake of brevity.

Figure 13:
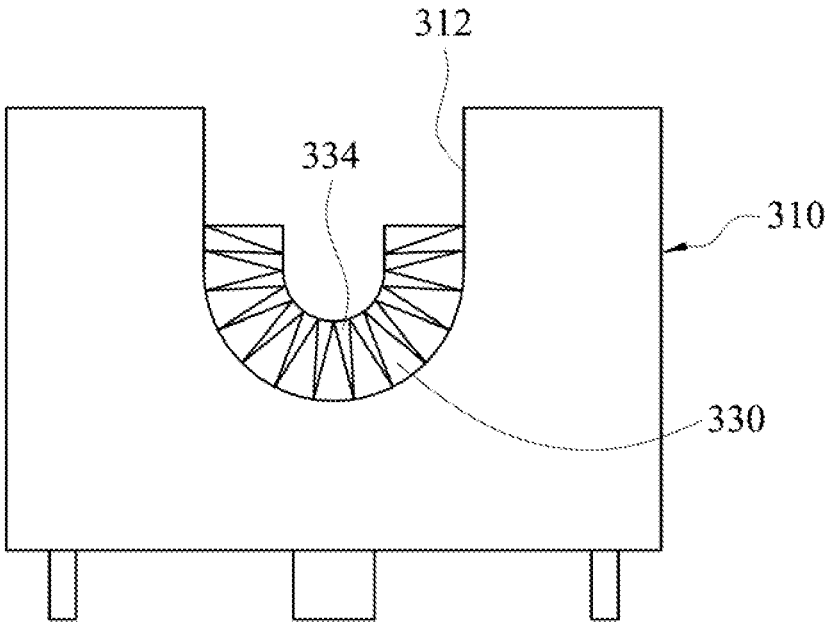
FIG. 13 is a diagram illustrating the metallic casing subject to the stamping process according to one embodiment of present disclosure.

FIG. 13 is a diagram illustrating the metallic casing 310 subject to the stamping process according to one embodiment of present disclosure. As illustrated in FIG. 13, before the execution of the stamping process, a cutting process is performed, in which a plurality of metallic elastic pieces 330 are cut at the opening 312 of the metallic casing 310, and said metallic elastic pieces 330 interlock with a metallic part 334. Next, performing the stamping process in which the metallic elastic pieces 330 interlocking with the metallic part 334 are removed such that the plurality of metallic elastic pieces 330 of the metallic casing 310 extend from the opening 312 of the metallic casing 310 toward the exterior of the metallic casing 310 by bending and forming, as illustrated in FIG. 6. Next, referring to FIG. 3, during the assembly process, the tuner adaptor 320 is embedded in the opening 312, so that the plurality of metallic elastic pieces 330 respectively interfere with the metallic outer surface 322 of the tuner adaptor 320, thereby reducing the parasitic capacitance between the to tuner adaptor 320 and the metallic casing 310 and hence lowering the impedance, so as to improve the shielding effect of the modular tuner.

Returning to FIG. 13, the metallic elastic pieces 330 created during the cutting process are triangular tooth-like metallic elastic pieces, and in one embodiment, the stamping process may comprise: applying a first stamping on the terminal ends of the plurality of triangular tooth-like metallic elastic pieces, such that the terminal end of each of the plurality of triangular tooth-like metallic elastic pieces forms a bending section 332, as illustrated in FIG. 7; and after applying the first stamping, applying a second stamping on the plurality of triangular tooth-like metallic elastic pieces, such that the plurality of triangular tooth-like metallic elastic pieces are bent and formed from the opening 312; also illustrated in FIG. 7.

Figure 14:
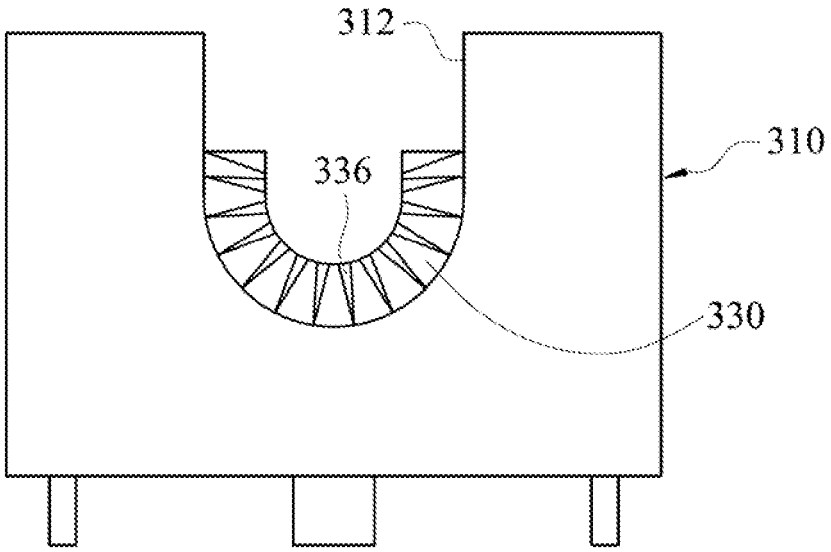
FIG. 14 is a diagram illustrating the metallic casing subject to the stamping process according to another embodiment of present disclosure.

FIG. 14 is a diagram illustrating the metallic casing 310 subject to the stamping process according to another embodiment of present disclosure. As illustrated in FIG. 14, before the execution of the stamping process, a cutting process is performed, in which a plurality of metallic elastic pieces 330 are cut at the opening 312 of the metallic casing 310, and said metallic elastic pieces 330 interlock with a metallic part 336. Next, performing the stamping process in which the metallic elastic pieces 330 interlocking with the metallic part 336 are removed such that the plurality of metallic elastic pieces 330 of the metallic casing 310 extend from the opening 312 of the metallic casing 310 toward the exterior of the metallic casing 310 by bending and forming, so as to obtain the tooth-like metallic elastic pieces as illustrated in FIG. 6. The following assembly process of the metallic casing with the tuner adaptor has been specifically discussed hereinabove, and hence, it is omitted herein for the sake of brevity.

Figure 15:
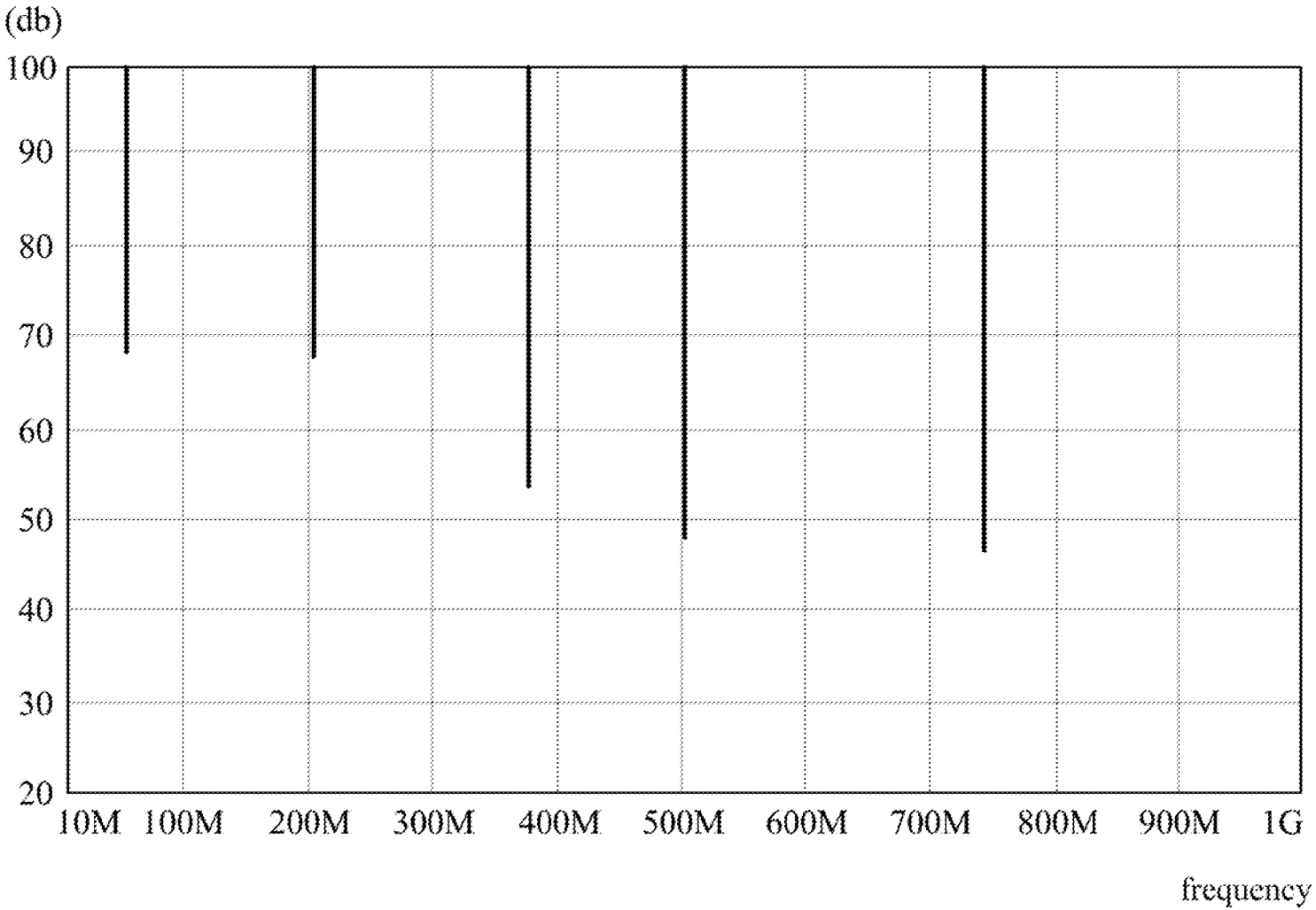
FIG. 15 is a test chart of the tuner of FIG. 1.

FIG. 15 is a test chart of the tuner of FIG. 1; the test is in compliance with item S4 (shielding effectiveness of antenna) of the EN55020 standard. The test result indicates that the worst shielding effect occurs at the frequency of 743.25 MHz, in which the shielding effect is lowered than the standard value (50 dB) by 3.7 dB, and hence, the conventional tuner of FIG. 1 is not in compliance with the regulation standard.

Figure 16:
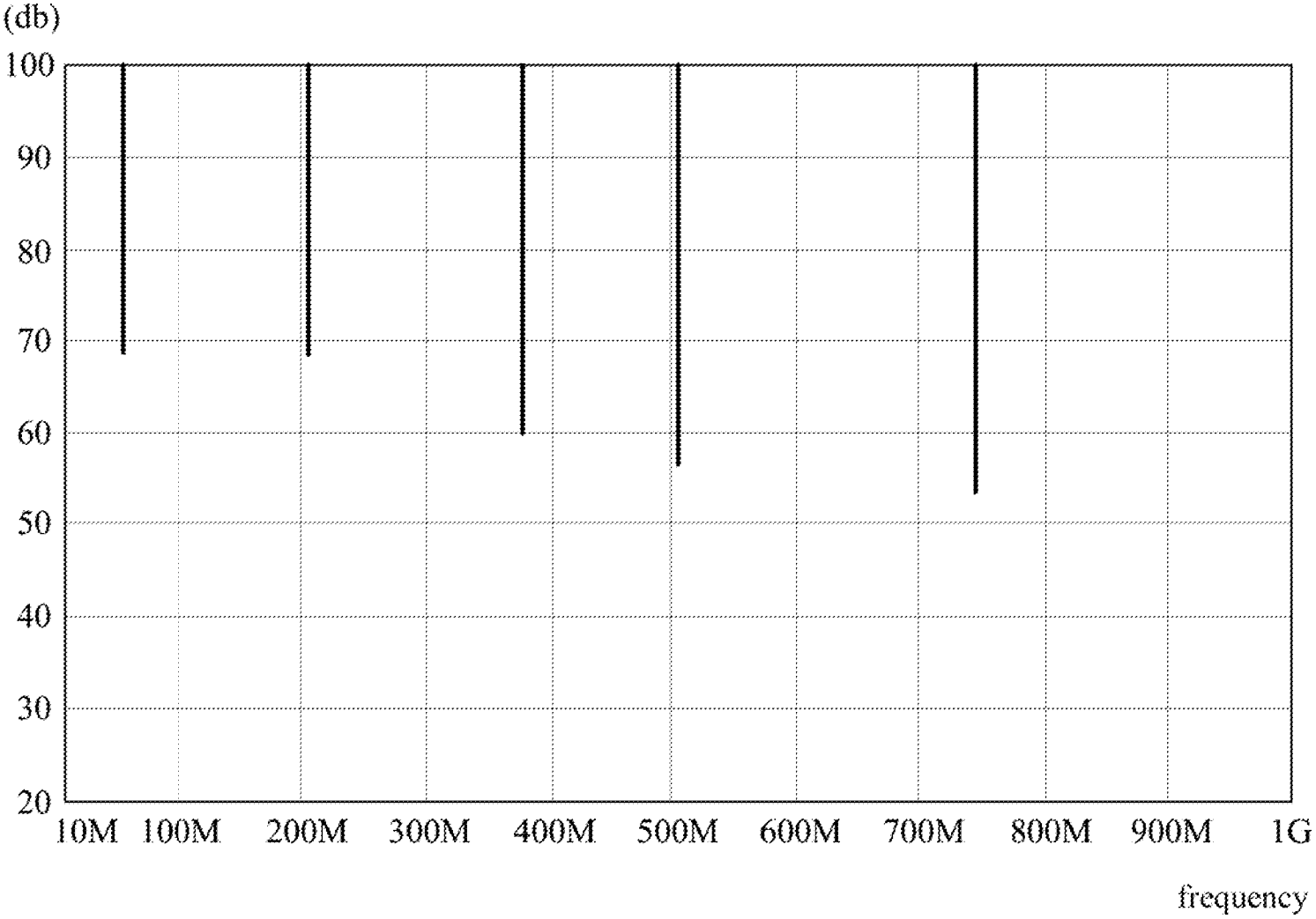
FIG. 16 is a test chart of a modular tuner according to one embodiment of present disclosure.

FIG. 16 is a test chart of a modular tuner according to one embodiment of present disclosure. As illustrated in FIG. 16, the modular tuner according to the present disclosure exhibits a better shielding effect, in which the lowest shielding effect is higher than the standard value (50 dB) by 3.6 dB; in comparison with the result presented in FIG. 15, an improvement of 7.3 dB is achieved, and the present modular tuner is in compliance with the regulation standard.

In view of the foregoing, the present invention starts from enhancing the EMC and aims at the structural improvements; by using the interference between the tuner adaptor and the metallic elastic pieces to lower the parasitic capacitance between the adaptor and the metallic casing and decrease the impedance, thereby improving the shielding effect of the tuner; on the other hand, regarding the metallic casing and the tuner adaptor, a flexible means for connecting and assembling the two is adopted which decreases the manufacturing cost associated with creating new molds as well as research and development cost.

Although various embodiments of the invention have been described above with a certain degree of particularity, or with reference to one or more individual embodiments, they are not limiting to the scope of the present disclosure. Those with ordinary skill in the art could make numerous alterations to the disclosed embodiments without departing from the spirit or scope of this invention. Accordingly, the protection scope of the present disclosure shall be defined by the accompany claims.

What is claimed is:

1. A modular tuner, comprising:

a metallic casing, having an opening;

a tuner adaptor, embedded in the opening, the tuner adaptor having a metallic outer surface; and a plurality of metallic elastic pieces, wherein the plurality of metallic elastic pieces and the metallic casing are integrally formed by stamping followed by bending, and the plurality of metallic elastic pieces of the metallic casing extends outwardly from the edge of the opening of the metallic casing, and respectively interfere with the metallic outer surface of the tuner adaptor, wherein the plurality of metallic elastic pieces are a plurality of triangular tooth-like metallic elastic pieces or a plurality of trapezoidal tooth-like metallic elastic pieces, wherein the metallic casing comprises: a metallic casing body, having at least three side walls, wherein one of the three side walls has the opening disposed thereon, and the plurality of triangular tooth-like metallic elastic pieces or the plurality of trapezoidal tooth-like metallic elastic pieces are arranged along a portion of the edge of the opening; and a metallic casing lid, coupled to the other two side walls of the metallic casing body, wherein the tuner adaptor has an annular groove, the opening has a notch formed on the upper edges of the side walls, and the metallic casing lid has a fastening, wherein the fastening is introduced into the notch and inserted into the annular groove thereby fixing the tuner adaptor.

2. The modular tuner according to the claim 1, wherein the terminal end of each of the plurality of triangular tooth-like metallic elastic pieces has a bending section, and the bending section directly contacts the metallic outer surface of the tuner adaptor.

3. The modular tuner according to the claim 1, wherein the metallic casing lid having a plurality of extension sections, wherein each extension section has a knock hole, the two side walls of the metallic casing body has a plurality of latching members, and the plurality of latching members are respectively coupled to the knock holes of the plurality of extension sections.

4. The modular tuner according to the claim 1, wherein the lower edges of the at least three side walls of the metallic casing body have a plurality of ground pins extended therefrom.

5. The modular tuner according to the claim 1, wherein one terminal end of the tuner adaptor enters the metallic casing body from the opening, and the other terminal end of the tuner adaptor has a surface mount pin or an inline pin.

* * * * *